US005872496A

United States Patent [19]

Asada et al.

[11] Patent Number: 5,872,496

[45] **Date of Patent: *Feb. 16, 1999**

[54] PLANAR TYPE ELECTROMAGNETIC RELAY AND METHOD OF MANUFACTURING THEREOF

[75] Inventors: Norihiro Asada, Saitama-ken; Masayoshi Esashi, Miyagi-ken, both of Japan

[73] Assignee: The Nippon Signal Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 505,321

[22] PCT Filed: Dec. 8, 1994

[86] PCT No.: PCT/JP94/02063

§ 371 Date: Nov. 1, 1995

§ 102(e) Date: Nov. 1, 1995

[87] PCT Pub. No.: WO95/17760

PCT Pub. Date: Jun. 29, 1995

[30] Foreign Application Priority Data

Dec. 20, 1993 [JP] Japan ..... 5-320525

[51] Int. Cl.[6] ..... H01H 51/22

[52] U.S. Cl. ..... 335/78; 335/80; 257/415

[58] Field of Search ..... 335/78–86, 124, 335/128; 257/415

[56] References Cited

U.S. PATENT DOCUMENTS

| | | | |
|---|---|---|---|
| 4,668,928 | 5/1987 | Davis et al. | 335/80 |
| 4,993,787 | 2/1991 | Tanaka et al. | 335/78 |
| 5,557,132 | 9/1996 | Takahashi | 335/78 |

FOREIGN PATENT DOCUMENTS

| | | |
|---|---|---|
| 0 573 267 A1 | 8/1993 | European Pat. Off. . |
| 39 14031 A1 | 10/1990 | Germany . |
| 42 05 029 C1 | 2/1992 | Germany . |

OTHER PUBLICATIONS

Patent Specification, 874,965, Inventors: D.F.A. McLachlan and L.S. Phillips, Filed: Oct. 6, 1959, Application Date: Jul. 9, 1958, Entitled: Improvements in or relating to Electrical Circuits or Circuit Elements.

Magnetically Driven Microactuator: Design Consideration by B. Wagner, W. Benecke, pp. 838–843, 11764 1st Int. Conf. on Micro Electro. Opto, Mechanic Systems and Components (1990) Berlin, DE.

Kenji Ono et al., "Extra Thin Signal Relay", Aug., 1987, Matsushita Kenko Giho No. 35.

Hiroshi Hosaka et al., "Electromagnetic Microrelays: Concepts and Fundamental Characteristics", Feb. 7–10, 1993, Fort Lauderdale, Florida—IEEE Robotics and Automation Society.

*Primary Examiner*—Lincoln Donovan
*Attorney, Agent, or Firm*—Wolf, Greenfield & Sacks, P.C.

[57] ABSTRACT

A slim-type small size electromagnetic relay is made using semiconductor manufacturing techniques to form a silicon substrate 2 having a planar movable plate 5 and a torsion bar 6 for axially supporting the movable plate 5 formed integrally therewith, with a planar coil 7 provided on an upper face of the movable plate 5 and a movable contact 9 provided on a lower face. Glass substrates 3, 4 are provided on upper and lower faces of the silicon substrate 2, with fixed contact 11 contactable with the movable contact 9 provided on the lower glass substrate 4. Permanent magnets 13A, 13B and 14A, 14B for producing a magnetic field at the planar coil 7 are fixed to the glass substrates 3, 4. Rotation of the movable plate 5 against the torsion force of the torsion bar 6 is controlled by passing a current through the planar coil 7 to produce a magnetic force, thereby causing contact or separation of the movable contact 9 and the fixed contact 11.

14 Claims, 14 Drawing Sheets

Fig. 11 (1)
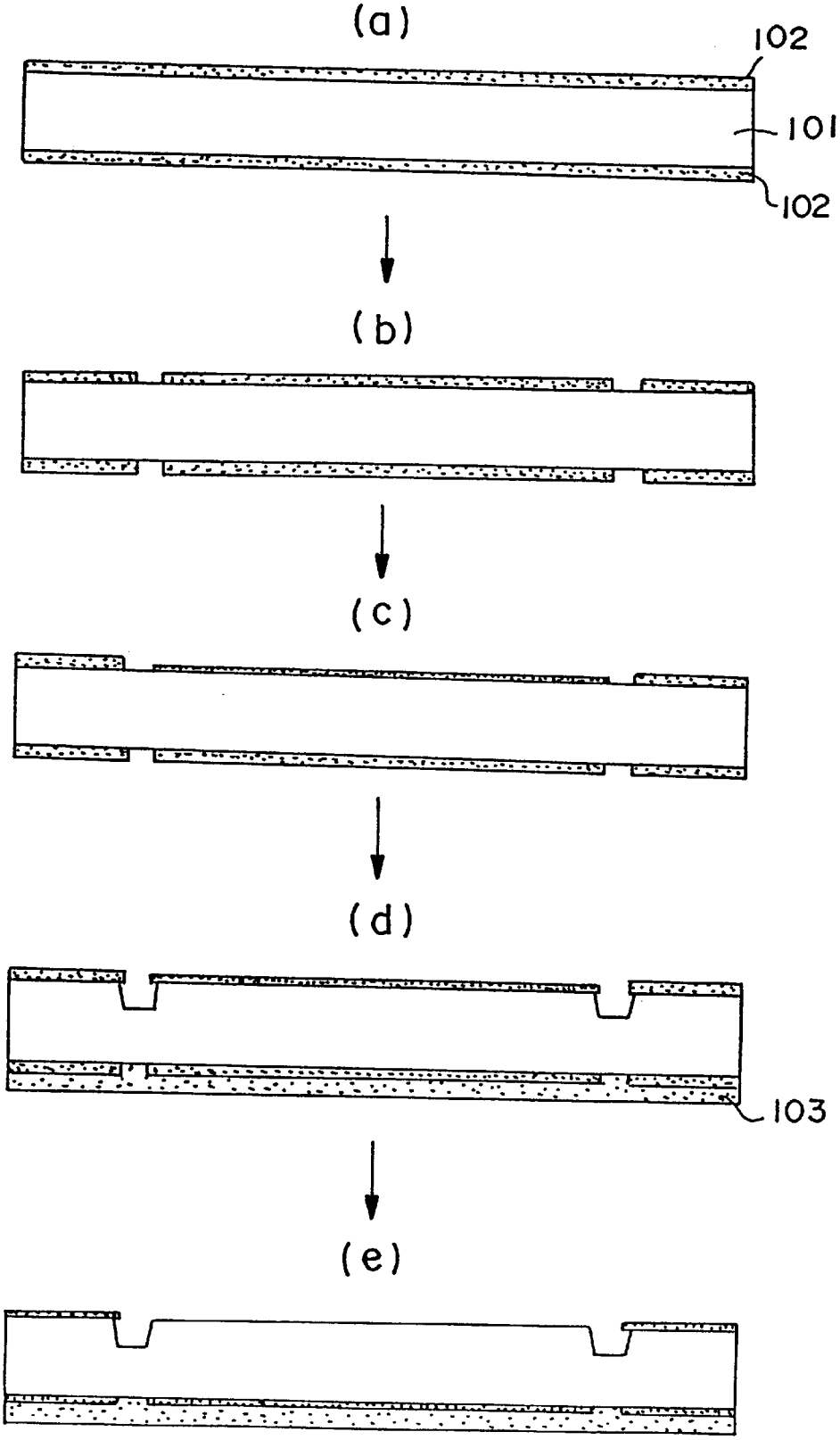

Fig. 11 (2)
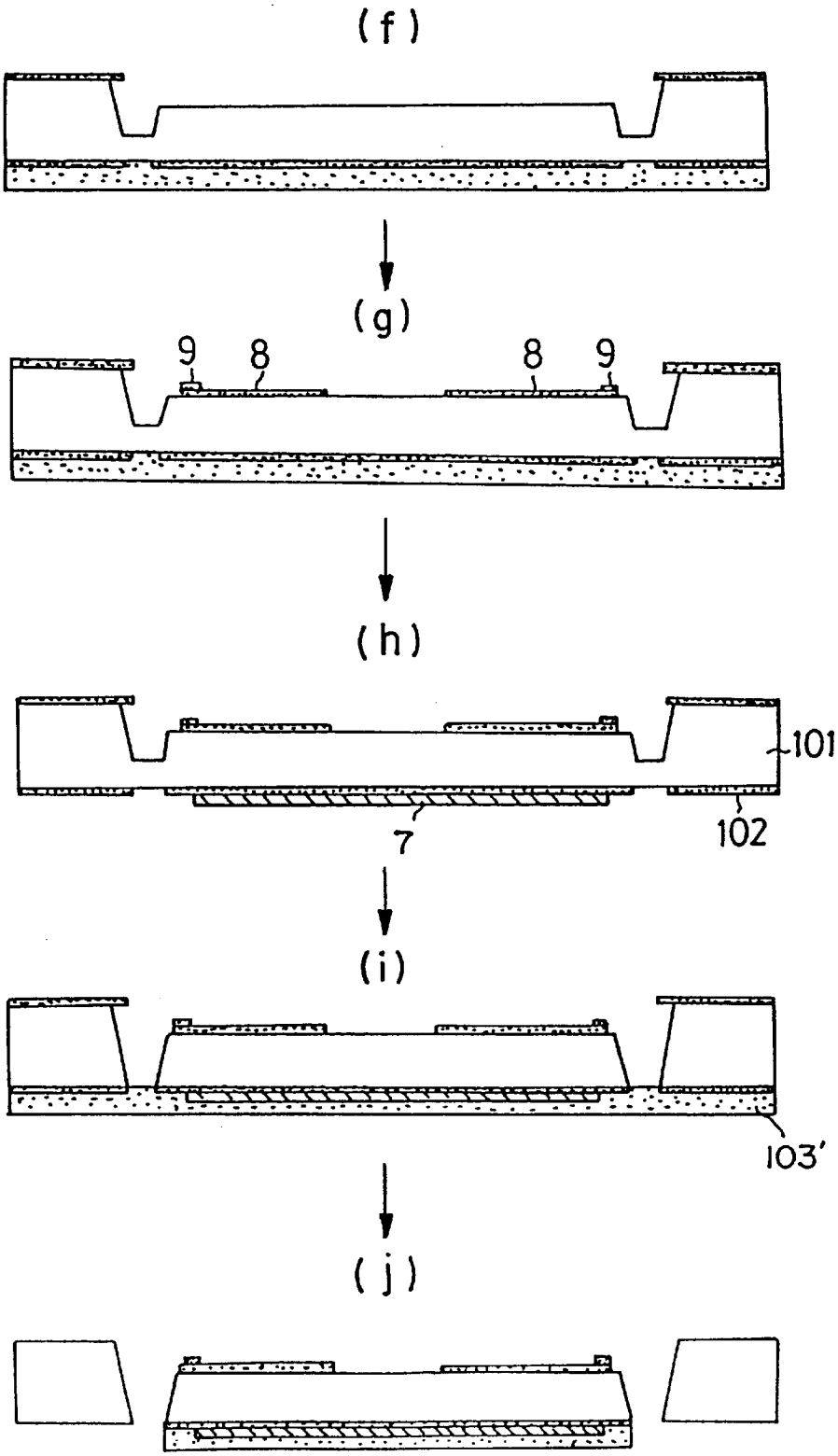

Fig. 12 (1)
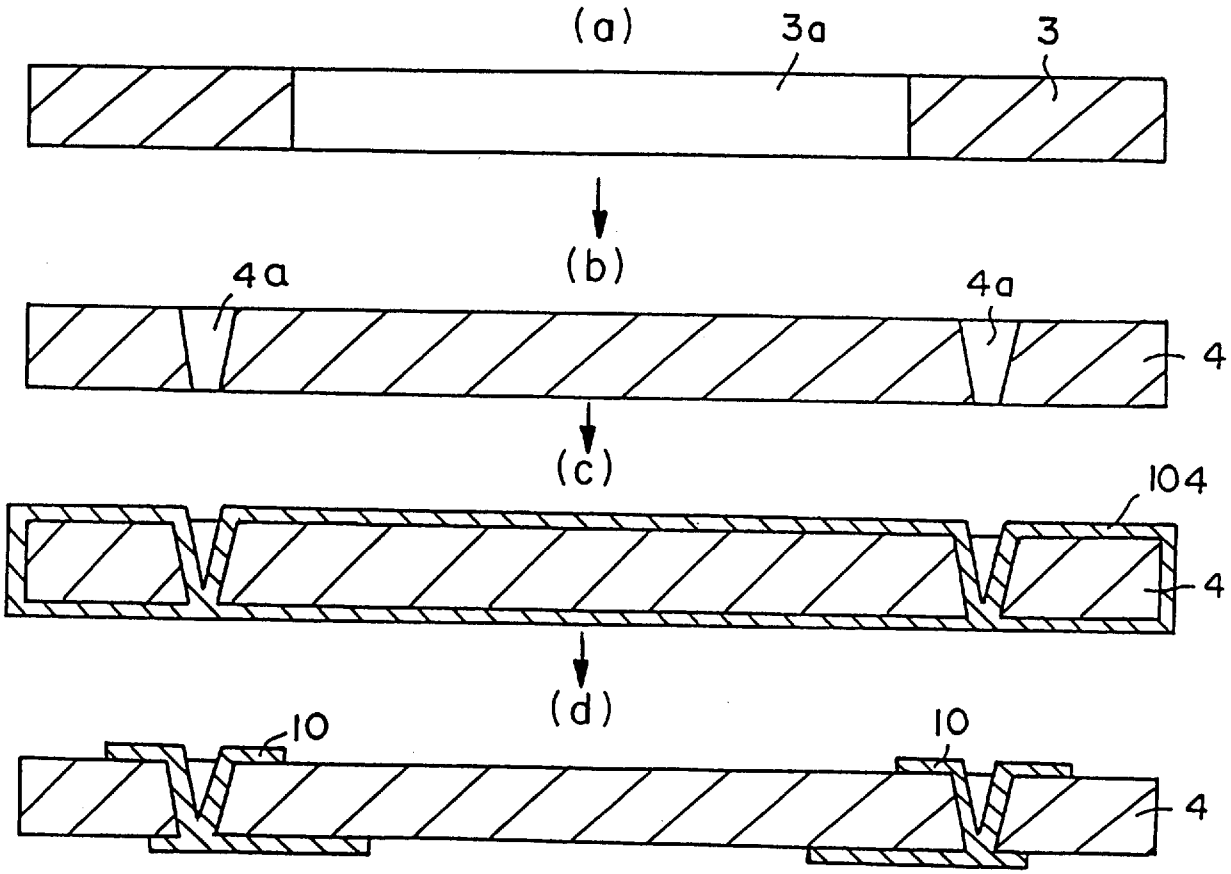

Fig. 12 (2)
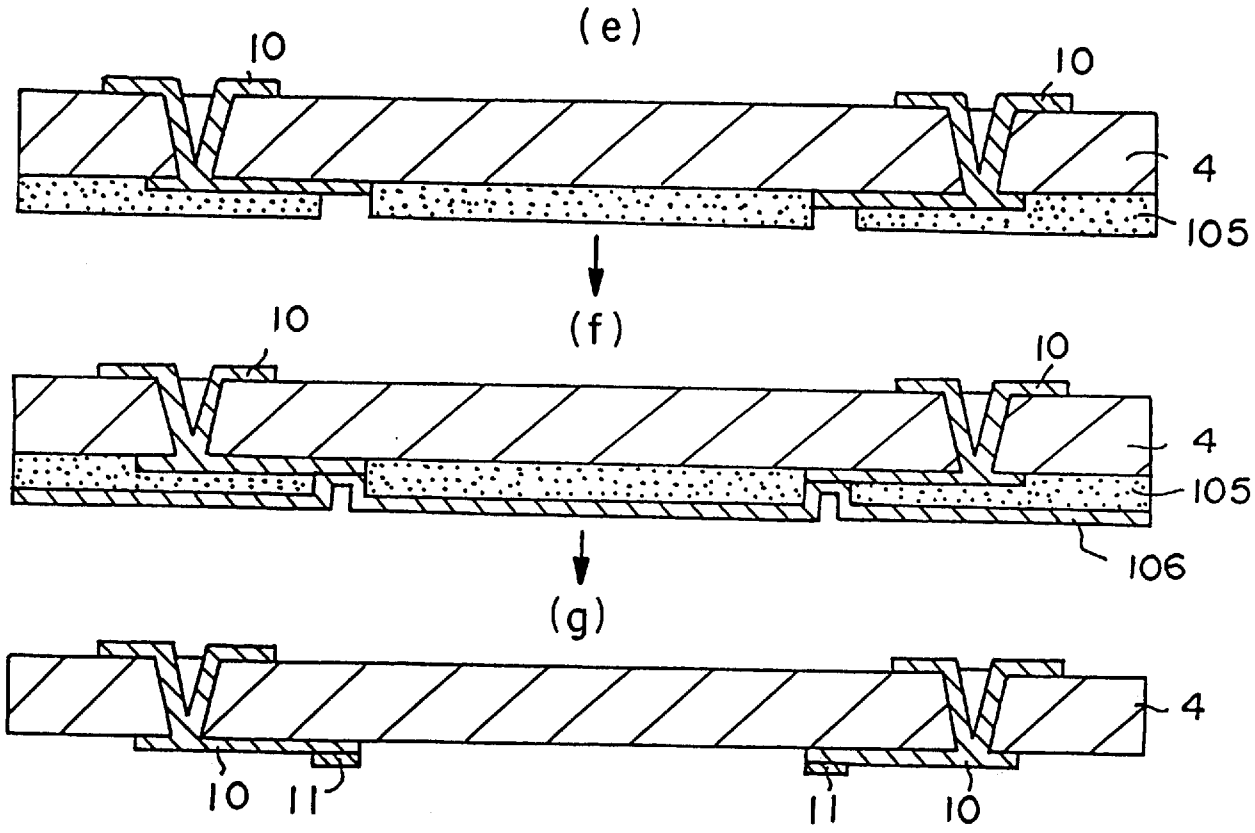

PLANAR TYPE ELECTROMAGNETIC RELAY AND METHOD OF MANUFACTURING THEREOF

TECHNICAL FIELD

The present invention relates to a planar type electromagnetic relay, manufactured using semiconductor element manufacturing techniques, and imethod of manufacturing thereof.

BACKGROUND ART

With the development of microelectronics involving the high integration of semiconductor devices, there is now a range of equipment which is both highly functional as well as being miniaturized. Industrial robot type control systems using a comparatively large amount of energy are also no exception. With this type of control system, control of high energy is controlled by an extremely small amount of energy, by incorporating microelectronics into the control equipment. As a result, problems with erroneous operation due to noise and the like arise, so that the demand for electromagnetic relays as final stage output devices is increasing.

Conventional electromagnetic relays occupy large volume, incomparably greater than that for semiconductor devices. Accordingly, in order to progress with miniaturization of equipment, miniaturization of electromagnetic relays is required.

Heretofore, the smallest standard wire wound type electromagnetic relay is 14 mm long, 19 mm wide and 5 mm high (refer to Ultra Thin Signal Relays, Matsushita Electric Publication, No. 35, pp27–31 (1987)).

Moreover, recently, in order to further miniaturize an electromagnetic relay, a planar type electromagnetic relay made using micro machining techniques has been proposed (refer to H Hosoka, H Kuwano and K. Yanagisawa, "Electromagnetic Micro Relays: Concepts and Fundamental Characteristics", Proc. IEEE MENS Workshop 93, (1993), pp.12–17).

With this planar type relay also however since the coil is a conventional wire wound type, miniaturization is limited.

The present invention takes into consideration the above situation, with the object of providing for further miniaturization of electromagnetic relays.

DISCLOSURE OF THE INVENTION

Accordingly, the planar type electromagnetic relay of the present invention comprises; a semiconductor substrate having a planar movable plate and a torsion bar for axially supporting the movable plate so as to be swingable in a perpendicular direction relative to the semiconductor substrate formed integrally therewith, a planar coil for generating a magnetic field by means of an electric current, laid on an upper face peripheral edge portion of the movable plate, and a movable contact portion provided on a lower face thereof, and an insulating substrate having a fixed contact portion provided on a lower face of the semiconductor substrate at a location wherein the fixed contact portion corresponds to said movable contact portion, and magnets forming pairs with each other arranged so as to produce a magnetic field at the planar coil portions on the opposite sides of the movable plate which are parallel with the axis of the torsion bar.

With such a construction, since the movable portion can be formed on the semiconductor substrate, and the planar coil formed on the movable plate, using a semiconductor element manufacturing process, then the coil portion can be made thinner and much smaller, enabling an electromagnetic rely very much smaller than conventional wire wound type devices.

The construction may also be such that an upper substrate is provided on an upper face of the semiconductor substrate, and the magnets are fixed to the upper substrate and to the insulating substrate on the lower face of the semiconductor substrate.

Moreover, the construction may be such that a movable plate accommodating space is tightly sealed by means of the upper substrate and the lower insulating substrate, and evacuated. The swinging resistance on the movable plate can thus be eliminated, enabling an increase in the response of the movable plate.

In this case, the movable plate accommodating space may be formed by providing a recess in a central portion of the upper substrate. A step in processing the semiconductor substrate to ensure a movable plate accommodating space in which the movable plate can swing freely can thus be omitted.

The upper substrate may also be an insulating substrate.

Moreover, the magnets may be permanent magnets.

Furthermore, the electromagnetic relay according to the present invention may comprise; a semiconductor substrate having a planar movable plate and a torsion bar for axially supporting the movable plate so as to be swingable in a perpendicular direction relative to the semiconductor substrate formed integrally therewith, a permanent magnet provided on at least an upper face peripheral edge portion of the movable plate, and a movable contact portion provided on a lower face thereof, and a planar coil for generating a magnetic field by means of an electric current, provided on semiconductor portions beside the opposite sides of the movable plate which are parallel with the axis of the torsion bar, and an insulating substrate having a fixed contact portion provided on a lower face of the semiconductor substrate at a location wherein the fixed contact portion corresponds to the contact portion of the movable plate.

If the planar coil is formed on the semiconductor substrate in this way, then it is not necessary to consider influence of heating of the planar coil by the electrical current.

Moreover, if the permanent magnet is made as a thin film, then there will be minimal influence on the swinging operation of the movable plate. Also, since the permanent magnet can be integrally formed by semiconductor manufacturing techniques, then the step of fitting the permanent magnet can be eliminated, thus simplifying manufacture of the electromagnetic relay.

In this case an upper substrate may be provided on the upper face of the semiconductor substrate, and a movable plate accommodating space tightly sealed by means of the upper substrate and the insulating substrate on the lower face of the semiconductor substrate, and evacuated.

A method of manufacturing an electromagnetic relay according to an aspect of the present invention comprises; a step of piercing a semiconductor substrate excluding a portion forming a torsion bar, by anisotropic etching from the substrate lower face to the upper face to form a movable plate which is axially supported on the semiconductor substrate by the torsion bar portion so as to be swingable, a step of forming a planar coil on the upper face periphery of the movable plate by electroplating, a step of forming a movable contact portion on a lower face of the movable plate, a step of forming a fixed contact portion contactable with said movable contact portion, on an upper face of a lower insulating substrate, a step of fixing an upper insulating substrate and the lower insulating substrate to upper and lower faces of the semiconductor substrate by anodic splicing, and a step of fixing magnets to the upper insulating substrate portion and the lower insulating substrate portion which correspond to the opposite sides of the movable plate which are parallel with the axis of the torsion bar.

A method of manufacturing an electromagnetic relay according to another aspect of the present invention comprises; a step of piercing a semiconductor substrate excluding a portion forming a torsion bar, by anisotropic etching from the substrate lower face to the upper face to form a movable plate which is axially supported on the semiconductor substrate by the torsion bar so as to be swingable, a step of forming a thin film permanent magnet on the upper face periphery of the movable plate, a step of forming a movable contact portion on a lower face of the movable plate, a step of forming a planar coil on semiconductor substrate portions beside the opposite sides of the movable plate which are parallel with the axis of said torsion bar by electroplating, a step of forming a fixed contact portion contactable with said movable contact portion, on an upper face of a lower insulating substrate, and a step of fixing an upper insulating substrate and the lower insulating substrate to upper and lower faces of the semiconductor substrate by anodic splicing.

With these methods of manufactuing the respective electromagnetic relays, the step of forming the planar coil may involve a coil electro-typing method. More specifically, this may involve forming a nickel layer on the semiconductor substrate by sputtering, then forming a copper layer on the nickel layer by electroplating or sputtering. Subsequently masking the portion corresponding to the planar coil portion and carrying out successive copper etching and nickel etching. Then removing the mask, and copper electroplating over the coil pattern.

If the planar coil is formed using the above methods, it is possible to lay a thin film coil with a low resistance at a high density.

BRIEF DESCRIPTION OF THE DRAWINGS

FIGS. 11 (*a*)–(*j*) are diagrams for explaining the silicon substrate manufacturing steps of the first embodiment;

FIGS. 12 (*a*)–(*g*) are diagrams for explaining the glass substrate manufacturing steps of the first embodiment;

BEST MODE FOR CARRYING OUT THE INVENTION

Figure 1:
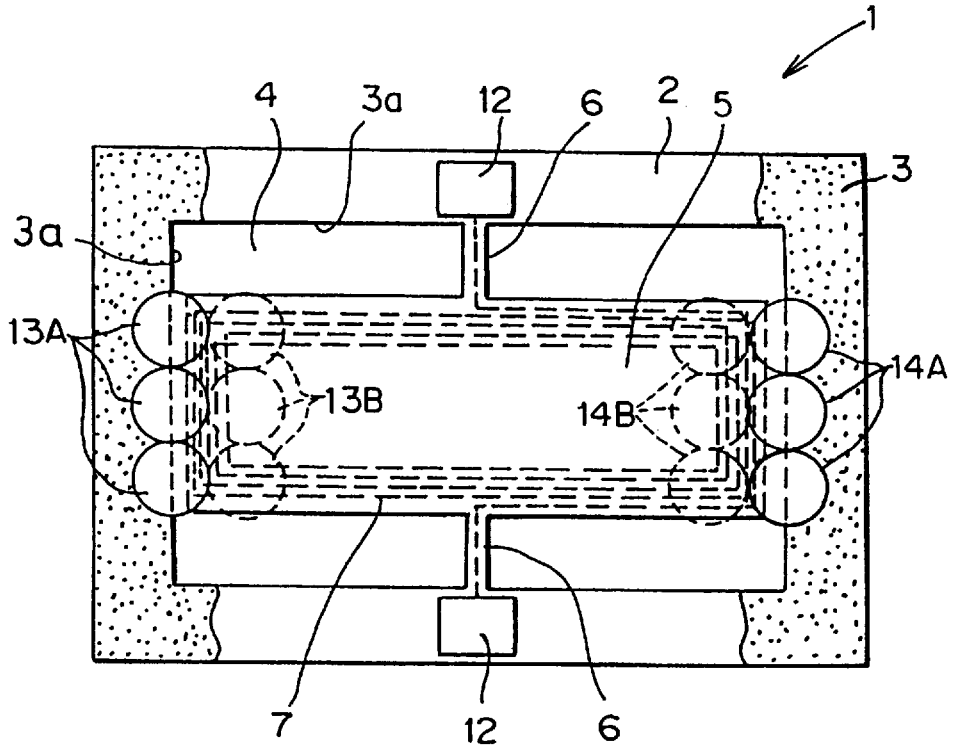
FIG. 1 is a schematic diagram showing the construction of a first embodiment of a planar type electromagnetic relay according to the present invention.

Embodiments of the present invention will now be described with reference to the figures.

FIGS. 1 to 4 show the construction of a first embodiment of a planar type electromagnetic relay according to the present invention.

In FIGS. 1 to 4, an electromagnetic relay 1 of this embodiment has a triple layer construction with respective upper and lower glass substrates 3, 4 (upper and lower insulating substrates) made for example from borosilicate glass and the like, anodic spliced to upper and lower faces of a silicon substrate 2 (semiconductor substrate). The upper glass substrate 3 has an opening 3*a* formed therein by for example ultrasonic machining so as to open an upper portion of a movable plate 5 discussed later.

Figure 3:
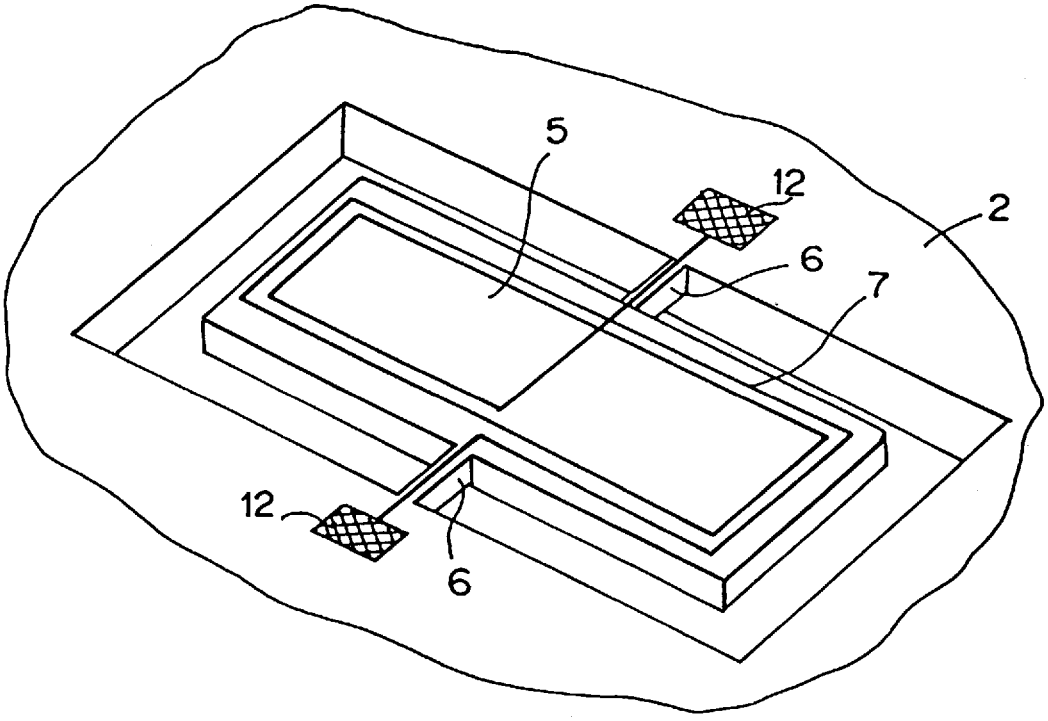
FIG. 3 is an enlarged perspective view of the upper face of the movable plate of the first embodiment.
Figure 4:
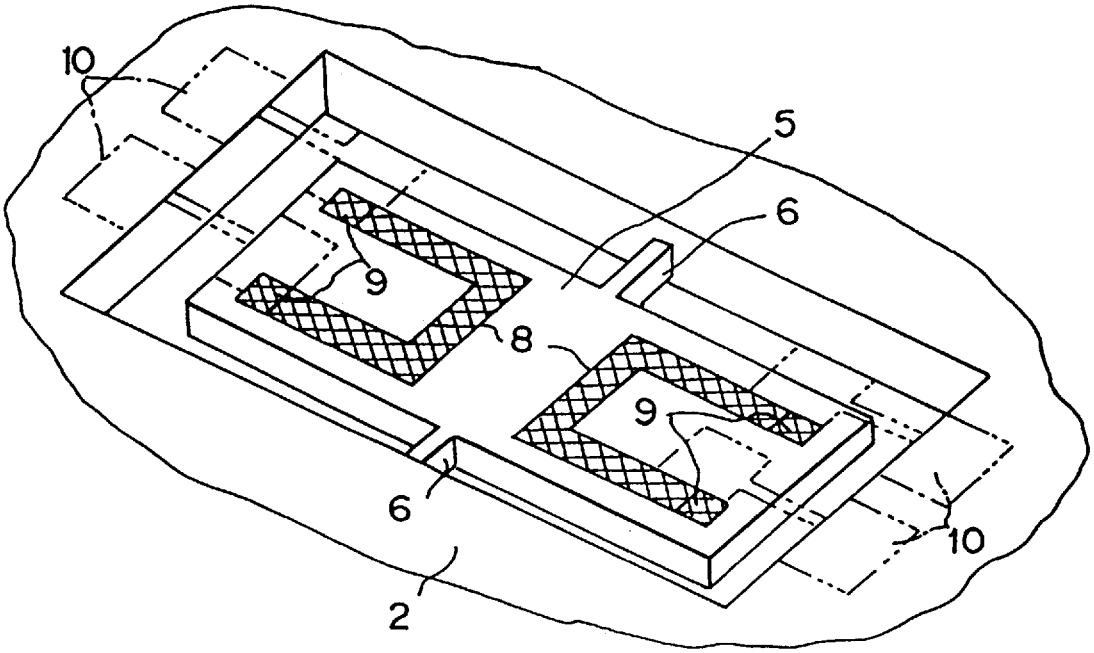
FIG. 4 is an enlarged perspective view of the lower face of the movable plate of the first embodiment.

The planar movable plate 5, and torsion bars 6, 6 for axially supporting the movable plate 5 at a central location thereof so as to be swingable in a perpendicular direction relative to the silicon substrate 2, are formed integrally with the silicon substrate 2 by anisotropic etching. The movable plate 5 and the torsion bars 6, 6 are therefore both made from the same material as the silicon substrate 2. As shown in FIG. 3, a planar coil 7 made from a thin copper film, for generating a magnetic field by means of an electrical current, is provided on the upper face peripheral edge portion of the movable plate 5 and covered with an insulating film. Here if the coil is laid at a high density as a high resistance thin film coil having a Joule heat loss due to the resistance, the drive force will be limited due to heating. Therefore, with the present embodiment, the planar coil 7 is formed by a heretofore known coil electro-typing method using electroplating. The coil electro-typing method has the characteristic that a thin film coil can be mounted with low resistance and at a high density, and is effective in the miniaturization and slimming of micro-magnetic devices. It involves forming a thin nickel layer on the semiconductor substrate by sputtering, then forming a copper layer on the nickel layer by electroplating or sputtering. Subsequently removing the copper layer and nickel layer except for the portions corresponding to the coil. Then copper electroplating over the coil pattern to form a thin film planar coil. As shown in FIG. 4, "C" shaped wiring 8, 8 is formed on lower face opposite sides of the movable plate 5. Movable contacts 9, 9 made for example of gold or platinum are provided at respective end portions of the wiring 8, 8.

Figure 2:
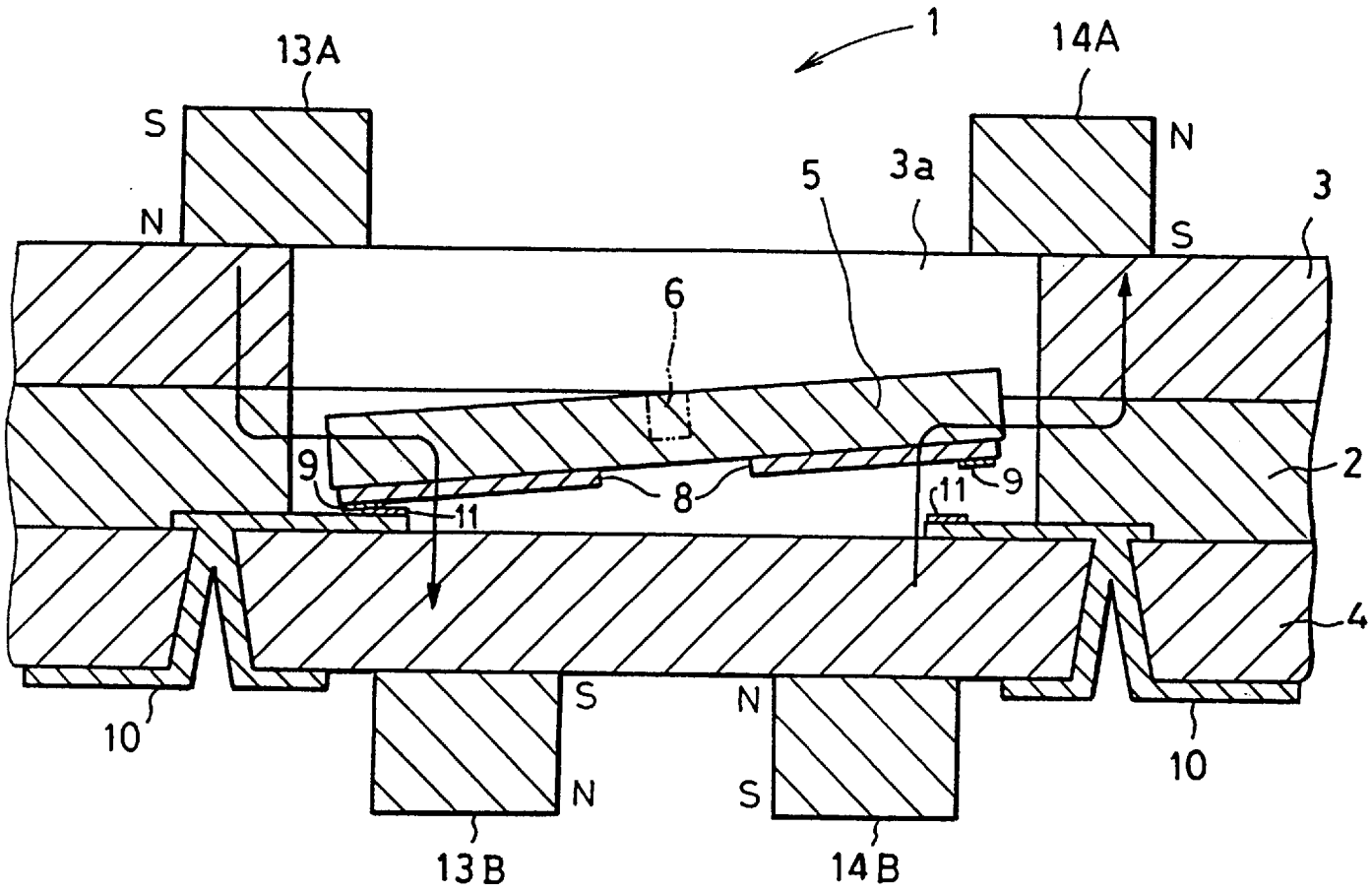
FIG. 2 is an enlarged longitudinal section of the first embodiment.

Moreover, wiring 10, 10 is formed on the upper face of the lower glass substrate 4 in a pattern as shown by the two-dot chain lines in FIG. 4, and fixed contacts 11, 11 also of gold or platinum are formed on the wiring 10, 10 at locations as shown in FIG. 2 corresponding to the movable contacts 9, 9. As shown in FIG. 2, the wiring 10, 10 is taken out of the lower side of the lower glass substrate 4 through holes formed therein.

A pair of electrode terminals 12, 12 electrically connected to the planar coil 7 by way of portions of the torsion bars 6, 6 are provided on the upper face of the silicon substrate 2 beside the torsion bars 6, 6. The electrode terminals 12, 12 are formed on the silicon substrate 2 at the same time as forming the planar coil 7, by the coil electro-typing method.

Cylindrical shaped permanent magnets 13A, 13B and 14A, 14B, are provided in pairs on the left and right sides in FIG. 1, of the upper and lower glass substrates 3, 4, so as to produce a magnetic field at the planar coil 7 portions on the opposite sides of the movable plate 5 which are parallel with the axis of the torsion bars 6, 6. One of the pairs of three permanent magnets 13A, 13B, is arranged as shown in FIG. 2 with the lower side the north pole and the upper side the south pole, while the other of the pairs of three permanent magnets 14A, 14B, are arranged as shown in FIG. 2 with the lower side the south pole and the upper side the north pole.

The operation will now be described.

Figure 5:
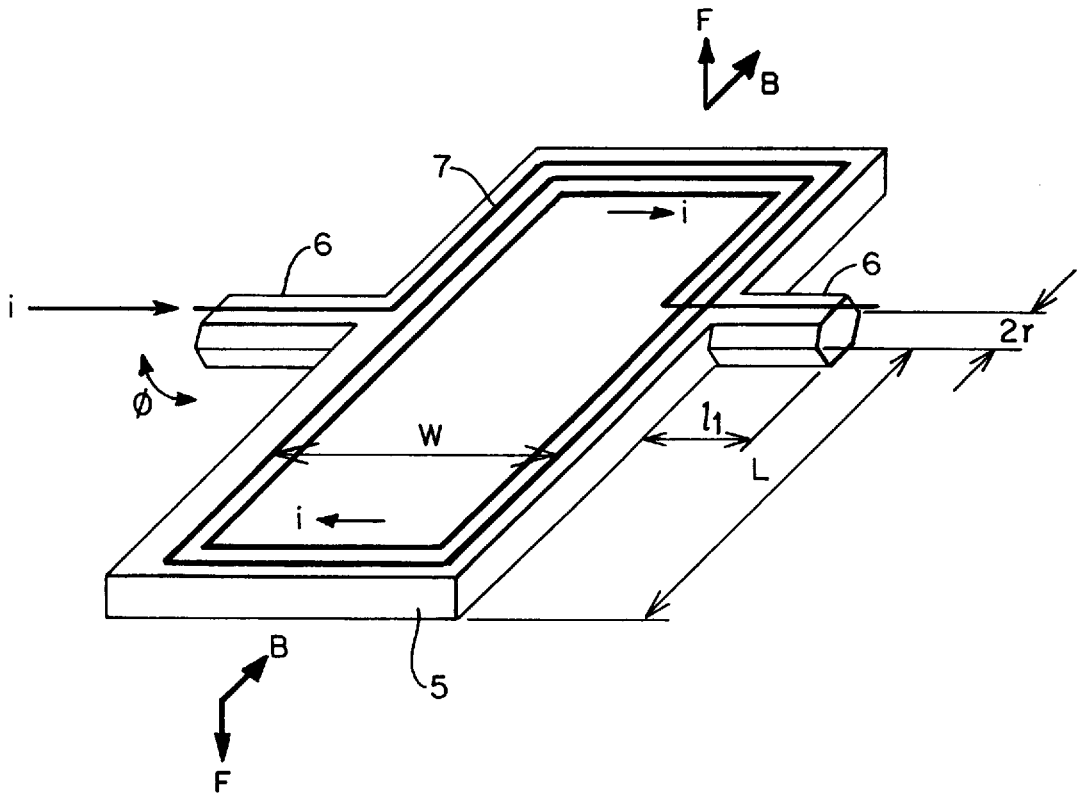
FIG. 5 is a diagram for explaining the operating theory of the electromagnetic relay of the present invention.

A current is produced in the planar coil 7 with one of the electrode terminal 12 as a positive terminal and the other as a negative terminal. A magnetic field at both edges of the movable plate 5 produced by means of the permanent magnets 13A and 13B and 14A and 14B follows along planar faces of the movable plate 5 as shown by the arrow in FIG. 2, between the upper and lower magnets, in a direction so as to intersect the planar coil 7. When a current flows in the planar coil 7 in this magnetic field, a magnetic force F which can be determined from the Lorentz's force, acts on the planar coil 7, in other words on the opposite ends of the movable plate 5, in a direction (as shown in FIG. 5) according to Fleming's left hand rule for current, magnetic flux density and force, depending on the current density and the magnetic flux density of the planar coil 7.

This magnetic force F can be determined from the following equation (1):

$$F = i \times B \tag{1}$$

where i is the current density flowing in the planar coil 7, and B is the magnetic flux density due to the permanent magnets 13A, 13B and 14A, 14B:

In practice, this force differs due to the number of windings n of the planar coil 7 and the coil length w (as shown in FIG. 5) over which the force F acts, so that the following equation (2) applies;

$$F = n\ w\ (i \times B) \tag{2}$$

The relationship between the displacement angle ϕ of the movable plate 5 and the resultant spring reactive force F' of the torsion bars 6, 6 when twisted with rotation of the movable plate 5, is given by the following equation (3):

$$\begin{aligned} \phi &= (Mx/Glp) \\ &= (F'L/8.5 \times 10^9\, r^4) \times l_1 \end{aligned} \tag{3}$$

where Mx is the torsional moment, G is the modulus of longitudinal elasticity, and Ip is the polar moment of inertia of area. Moreover, L, $l_1$ and r are respectively, the distance from the torsion bar central axis to the load point, the torsion bar length, and the torsion bar radius as shown in FIG. 5.

The movable plate 5 rotates to a position wherein the magnetic force F is in equilibrium with the spring reactive force F'. Therefore, substituting F of equation 2 for F' of equation 3 shows that the displacement angle ϕ of the movable plate 5 is proportional to the current i flowing in the planar coil 7.

Accordingly, if sufficient current can be passed through the planar coil 7 to move the movable contacts 9, 9 on the movable plate 5 lower side against the spring force of the torsion bar 6, so as to press against the fixed contacts 11, 11 on the upper face of the lower glass substrate 4, then the movable contacts 9, 9 can be made to contact against the fixed contacts 11, 11 by rotation of the movable plate 5. Therefore by changing the direction of the current in the planar coil 7, or switching the current on and off, it becomes possible to switch the contacts or switch on or off a power supply.

Measurement results of magnetic flux density distribution due to the permanent magnets in the electromagnetic relay of the embodiment will now be described.

Figure 6:
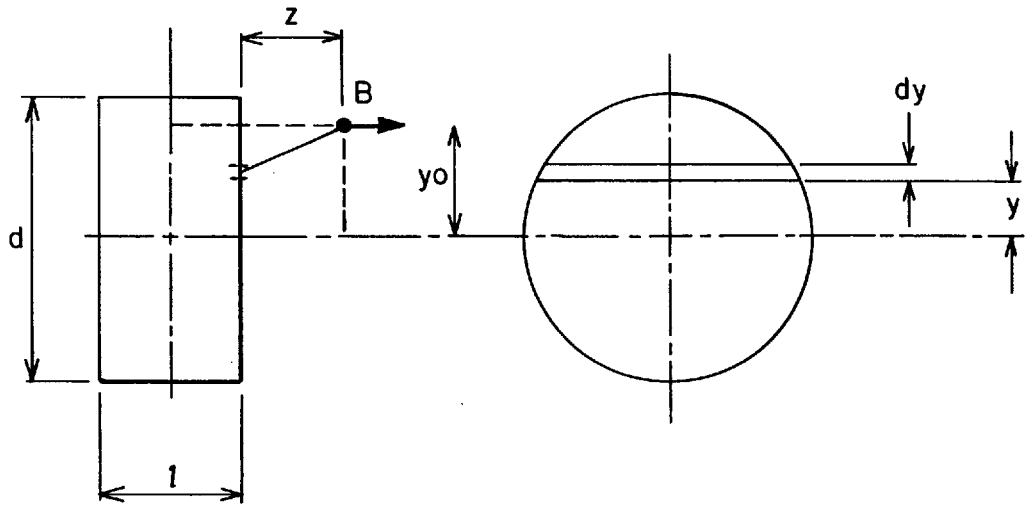
FIG. 6 is a computational model diagram for computing magnetic flux density distribution due to a permanent magnet of the first embodiment.

FIG. 6 shows a magnetic flux density distribution computation model for the cylindrical shaped permanent magnet used in the present embodiment. Respective north and south pole faces of the permanent magnet are divided up into very small regions dy, and the magnetic flux density for the resultant points computed.

If the magnetic flux density produced at the north pole face is Bn and the magnetic flux density produced at the south pole face is Bs, these can be obtained from the computational formula for the magnetic flux density distribution of a cylindrical shaped permanent magnet, according to equations (4) and (5). The magnetic flux density B at an optional point becomes the sum of Bn and Bs as given by equation (6):

$$Bn = \frac{Br}{2\pi} \int_{-d/2}^{d/2} \frac{z\,[(d/2)^2 - y^2]^{1/2} dy}{[(y - yo)^2 + z^2]\,[(d/2)^2 + z^2 + yo^2 - 2yoy]^{1/2}} \tag{4}$$

$$Bs = \frac{Br}{2\pi} \int_{-d/2}^{d/2} \frac{(z + 1)\,[(d/2)^2 - y^2]^{1/2} dy}{[(y - yo)^2 + (z + 1)^2]\,[(d/2)^2 + (z + 1)^2 + yo^2 - 2yoy]^{1/2}} \tag{5}$$

$$B = Bn + Bs \tag{6}$$

Here in the respective equations (4) and (5), Br is the residual magnetic flux density of the permanent magnet, y, z are coordinates at an optional point in space in the vicinity of the permanent magnet, l is the distance between the north and south pole faces of the permanent magnet, and d is the diameter of the polar faces.

Figure 7:
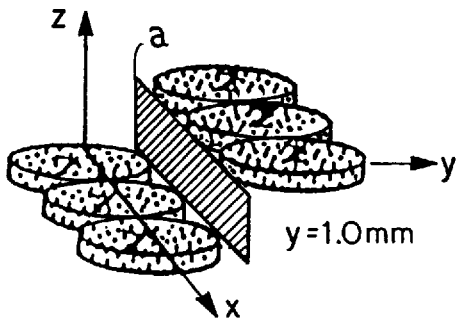
FIG. 7 is a diagram illustrating locations of the computed magnetic flux density distribution.
Figure 8:
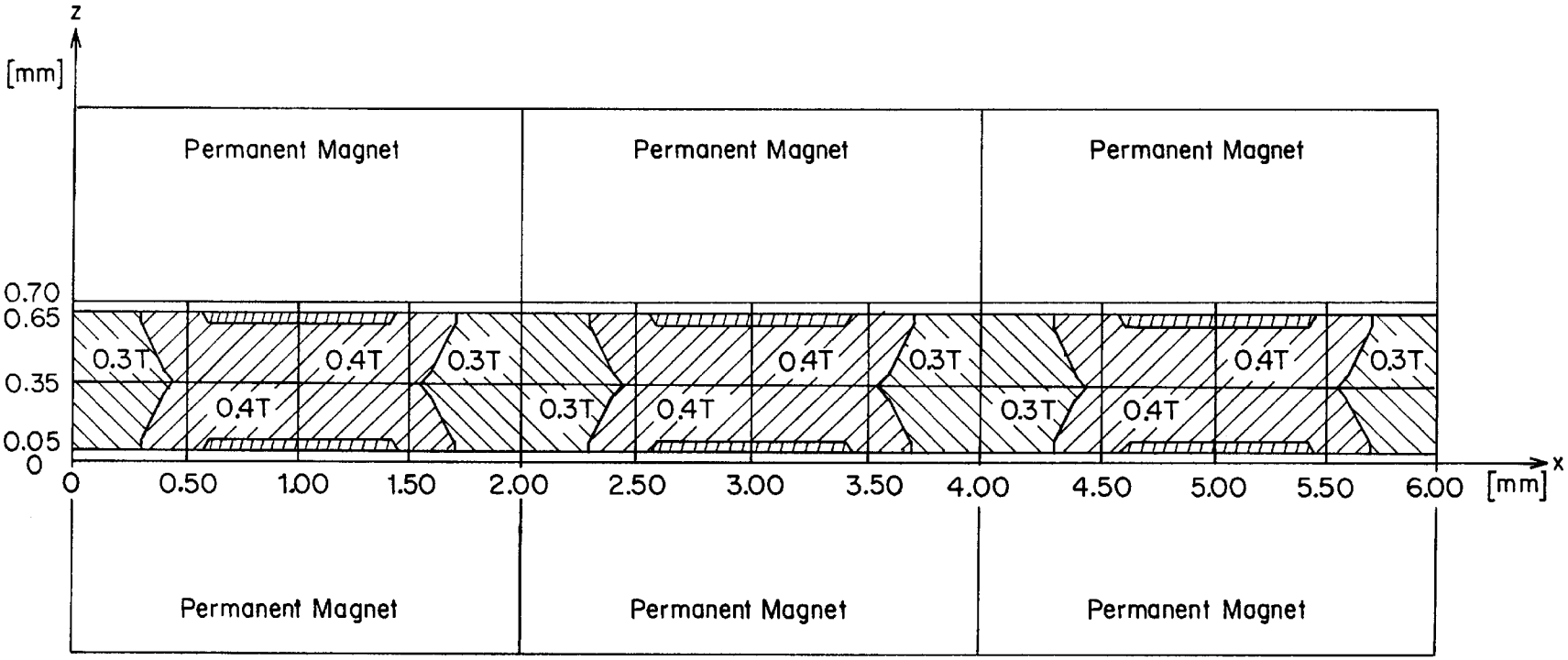
FIG. 8 is a diagram of computational results of magnetic flux density distribution at the locations shown in FIG. 7.

The computed results for the magnetic flux density distribution in a surface "a" arranged as shown in FIG. 7 perpendicular to the faces of the permanent magnets, are given in FIG. 8 for an example using a DIANET DM-18 (trade name; product of Seiko Electronics) Sm-CO permanent magnet of 1 mm radius, 1 mm thickness and a residual magnetic flux density of 0.85 T. In FIG. 7, x, y, z are coordinates at an optional point in the vicinity of the permanent magnet.

When arranged as shown in FIG. 7, the space between the permanent magnets has a magnetic flux density of equal to or greater than 0.3 T.

The computational results for the displacement of the movable plate 5 will now be described.

These are obtained from equations (2) and (3), with the width of the planar coil 7 formed on the movable plate 5 as 100 μm and the number of windings as 14, the width of the movable plate 5 as 4 mm, the length as 5 mm, and the thickness as 20 μm, and the radius of the torsion bar 6 as 25 μm and the length as 1 mm. For the magnetic flux density, a value of 0.3 T obtained from the beforementioned magnetic flux density distribution computation was used.

Figure 9A:
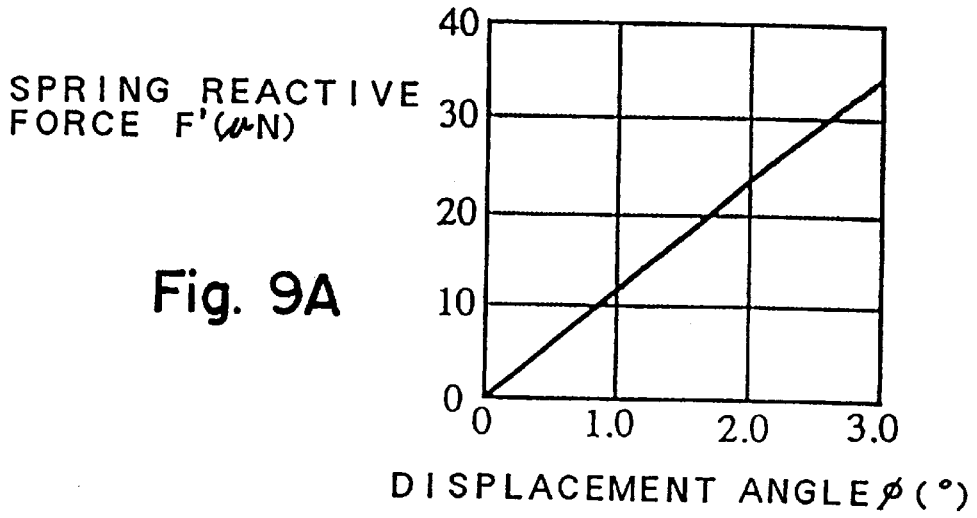
FIG. 9 shows graphs of computational results for movable plate displacements and electrical current.
Figure 9B:
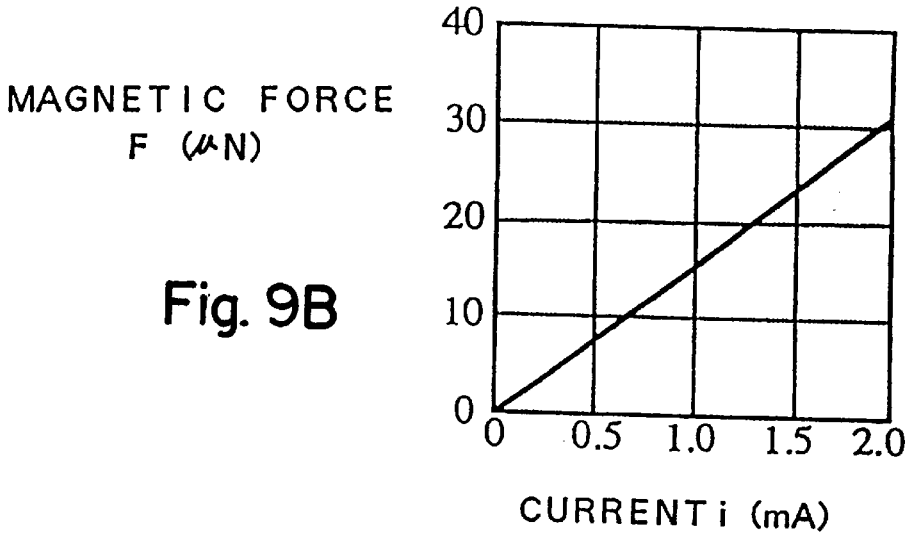
Figure 9C:
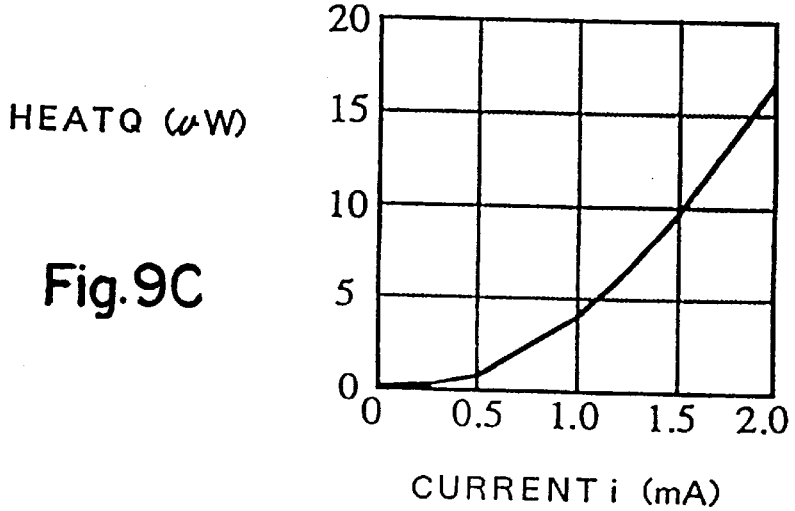

The result from graphs (A) and (B) of FIG. 9 shows that a current of 1.5 mA, gives a two degree displacement angle.

FIG. 7 (C) shows the relationship between current and the amount of heat Q generated. The amount of heat generated per unit area at this time is 13 $\mu$watt/cm$^2$.

The relationship between the amount of heat generated and the amount lost will now be explained.

The amount of heat generated is the Joule heat generated by the resistance of the coil. Therefore the amount of heat Q generated per unit time can be expressed by the following equation (7).

$$Q=i^2R \tag{7}$$

where; i is the current flowing in the coil and R is the resistance of the coil. The amount of heat lost Qc due to heat convection can be expressed by the following equation (8).

$$Qc=hS\Delta T \tag{8}$$

where; h is the heat transfer coefficient ($5\times10^{-3}$–$5\times10^{-2}$ watt/cm$^2$ °C. for air), S is the surface area of the element, and ΔT is the temperature difference between the element surface and the air.

If the surface area of the movable plate (heat generating portion) is 20 mm$^2$ (4×5 mm) then equation (8) gives;

$$Qc=1.0\ \Delta T\ (m\ \text{watt/°C.}) \tag{8'}$$

This shows that if the amount of heat generated is about several tens of watts/cm$^2$, problems with temperature rise of the element can be disregarded.

For a reference, the amount of heat lost Qr due to radiation can be expressed by the following equation (9);

$$Qr=\epsilon S\ \sigma T^4 \tag{9}$$

where; ϵ is the radiation factor (for a black body ϵ=1, while generally ϵ<1), S is the surface area of the element, C is the Stefan-Boltzmann constant ($\pi^2k^4/60\ h^3c^2$), and T is the element surface temperature.

The amount of heat lost Qa due to conduction from the torsion bar can be expressed by the following equation (10)

$$Qa=2\lambda\ (S/l_1)\Delta T \tag{10}$$

where; λ is the thermal conductivity (84 watts/mK for silicon), S is the cross sectional area of the torsion bar, $l_1$ is the length of the torsion bar, ΔT is the temperature difference between the ends of the torsion bar. If the radius of the torsion bar is 25 $\mu$m and the length is 1 mm, then equation (10) gives;

$$Qa=0.1\Delta T(m\ \text{watt/°C.}) \tag{10'}$$

The bending of the torsion bar due to the weight of the movable plate, and the bending of the movable plate due to the electromagnetic force will now be explained.

Figure 10:
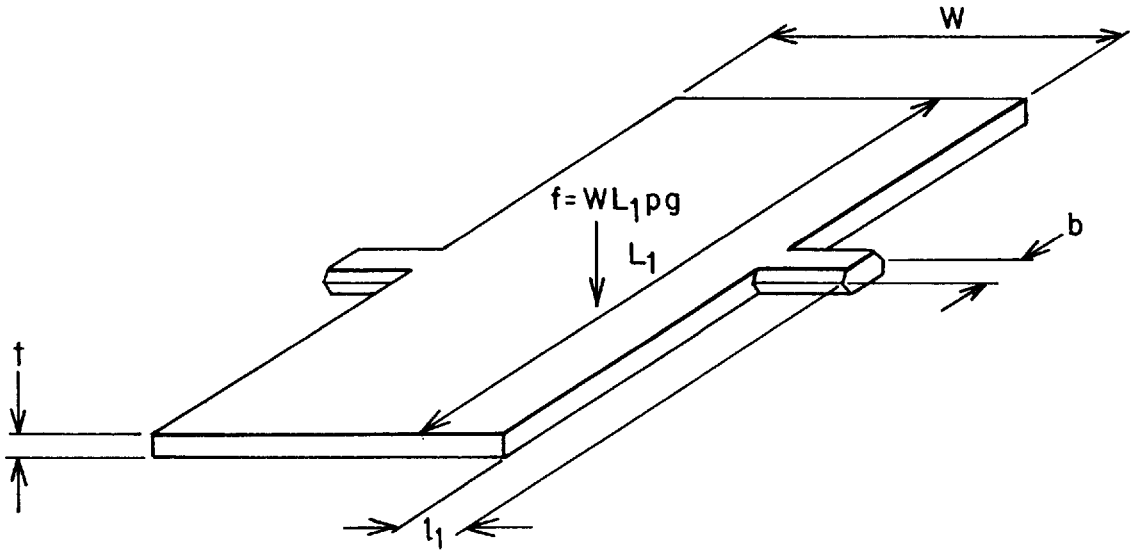
FIG. 10 is a computational model diagram for computing deflection of the torsion bar and movable plate.

FIG. 10 shows a computational model for this. With a torsion bar length of $l_1$, a torsion bar width of b, a movable plate weight of f, a movable plate thickness of t, a movable plate width of W, and a movable plate length of $L_1$, then using the computational method for the bending of a cantilever, the bending ΔY of the torsion bar is given by the following equation (11):

$$\Delta Y=(1/2)\ (4l_1^3f/E\ b\ t^3) \tag{11}$$

where; E is the Young's modulus for silicon.

The weight f of the movable plate is given by the following equation (12):

$$f=W\ L_1\ t\ \rho\ g \tag{12}$$

where; ρ is the volumetric density and g is the gravitational acceleration.

The bending ΔX of the movable plate, using the same computational method for the bending of a cantilever, is given by the following equation (13):

$$\Delta X=4(L^1/2)^3F/EWt^3 \tag{13}$$

where; F is the magnetic force acting on the edge of the movable plate. The magnetic force F is obtained by assuming the coil length w in equation (2) to be the width W of the movable plate.

The computational results for the bending of the torsion bar and the bending of the movable plate are given in Table 1. The bending of the movable plate is calculated for a magnetic force F of 30 $\mu$N.

TABLE 1

Computational Results for the Bending of the Torsion Bar and Movable Plate

| | | | |
|---|---|---|---|
| W | 6mm | 6mm | 6mm |
| $L_1$ | 13mm | 13mm | 13mm |
| t | 50$\mu$m | 50$\mu$m | 100$\mu$m |
| b | 50$\mu$m | 50$\mu$m | 50$\mu$m |
| $1_1$ | 0.5mm | 1.0mm | 1.0mm |
| f | 89$\mu$N | 89$\mu$N | 178$\mu$N |
| ΔY | 0.022$\mu$m | 0.178$\mu$m | 0.356$\mu$m |
| ΔX | 0.125$\mu$m | 0.125$\mu$m | 0.016$\mu$m |

As can be seen from Table 1, with a torsion bar of width 50 $\mu$m and length 1 mm, the bending ΔY due to a movable plate of width 6 mm, length 13 mm, and thickness 50 $\mu$m is 0.178 $\mu$m. If the thickness of the movable plate is doubled to 100 $\mu$m, then the bending ΔY is still only 0.356 $\mu$m. Furthermore, with a movable plate of width 6 mm, length 13 mm, and thickness 50 $\mu$m, the bending ΔX due to magnetic force is only 0.125 $\mu$m. If the amount of displacement at opposite ends of the movable plate during operation is around 200 $\mu$m, then this small amount will have no influence on the characteristics of the electromagnetic relay of the present embodiment.

As described above, with the electromagnetic relay of the present embodiment, influence due to heat generated by the coil can also be disregarded. Moreover, since the swing characteristics of the movable plate 5 present no problems, functions the same as with conventional devices can be realized. Furthermore, by using a semiconductor element manufacturing process, to form the parts such as the movable contact portion and the coil, then an ultra small size thin electromagnetic relay, very much smaller than conventional device becomes possible. Control systems which control final stage outputs by means of an electromagnetic relay can thus be miniaturized. Additionally, through using a semiconductor element manufacturing process, mass production becomes possible.

With the present embodiment, a permanent magnet is used to produce the magnetic field, however an electromagnet may also be used. Furthermore, while the construction involves a substrate with the magnets fixed thereto, if the magnets can be alternatively fixed at a predetermined location, it is not necessary to fix them to the substrate.

The steps in the manufacture of the electromagnetic relay according to the first embodiment will now be described with reference to FIGS. 11 and 12.

FIGS. 11 (*a*)–(*j*) show the manufacturing steps for the silicon substrate.

The upper and lower faces of a 300 μm thick silicon substrate 101 are first thermally oxidized to form an oxide film (1 μm) 102 (see figure (a)).

A cut-out pattern is then formed on the front and rear faces by photolithography, and the oxide film in the cut-out portion removed by etching (see figure (b)). After this, the oxide film on the rear face (upper face in FIG. 11) of the portion forming the movable plate is removed down to a thickness of 0.5 μm (see figure (c)).

A wax layer 103 is then applied to the front face (lower face in FIG. 11), and anisotropic etching carried out on the rear surface cut-out portion by 100 microns (see figure (d)). After this, the thin oxide film on the movable plate portion on the rear face is removed (see figure (e)), and anisotropic etching carried out on the cutout portion, and the movable plate portion by 100 microns (see figure (f)).

The silicon substrate portion corresponding to the rear face of the movable plate surrounded by the cut-out is then masked except for the wiring portion, and nickel or copper sputtering carried out to form the "C" shaped wiring 8, 8. After this the area except the movable contact portion is masked, and a gold or platinum layer formed for example by vapor deposition to thus form the movable contacts 9, 9 (see figure (g)).

The wax layer 103 on the front face is then removed, and the planar coil 7 and the electrode terminal portions (not shown in the figure) are formed on the front face oxide film 102 by a conventional electro-typing method for coils. The electro-typing method for coils involves forming a nickel layer on the oxide film 102 on the front face of the silicon substrate 101 by nickel sputtering, then forming a copper layer by electroplating or sputtering. The portions corresponding to the planar coil and the electrode terminals are then masked with a positive type resist, and copper etching and nickel etching successively carried out, after which the resist is removed. Copper electroplating is then carried out so that the whole peripheral edge of the nickel layer is covered with copper, thus forming a copper layer corresponding to the planar coil and the electrode terminals. After this, a negative type plating resist is coated on the areas except the copper layer, and copper electroplating carried out to thicken the copper layer to form the planar coil and the electrode terminals. The planar coil portion is then covered with an insulating layer of for example a photosensitive polyimide and the like. When the planar coil is in two layers, the process can be repeated again from the nickel sputtering step to the step of forming the insulating layer (see figure (h)).

A wax layer 103' is then provided on the front surface, and after masking the rear face portion of the movable plate, anisotropic etching carried out on the cut-out portion down to a 100 microns to cut through the cut-out portion. The wax layer 103' is then removed except for on the movable plate portion. At this time, the upper and lower oxide films 102 are also removed. In this way, the movable plate 5 and the torsion bar (not shown in the figure) are formed, thus forming the silicon substrate 2 of FIG. 1 (see figures (i) and (j)).

In the above manner, the movable plate 5 and the torsion bar of the silicon substrate 2 are formed integrally together.

Subsequently, the wax layer on the movable plate portion is removed and the upper glass substrate 3 and the lower glass substrate 4 are joined to the upper and lower faces of the silicon substrate 2 by anodic splicing. The permanent magnets 13A, 13B and 14A, 14B can then be mounted at predetermined locations on the upper and lower glass substrates 3, 4.

The steps in the manufacture of the upper and lower glass substrates will now be described with reference to FIGS. 12 (*a*)–(*g*).

At first an opening is formed, for example by ultra sonic machining, in the upper glass substrate 3 at a location corresponding to the region above the movable plate, thus forming an opening 3*a* (see figure a). With the lower glass substrate 4, at first apertures 4*a*, 4*a* for through holes are formed from the rear face (upper face in FIG. 12) of the glass substrate 4 by electrolytic discharge machining (see figure (b)). A metal layer 104 is then formed on both sides of the lower glass substrate 4 by for example nickel or copper sputtering (see figure (c)).

The wiring portion including the apertures 4*a* is then masked, and the remaining area etched to remove the metal layer 104, to thereby form the wiring 10, 10 (see figure (d)).

The pattern of the fixed contact points is then formed by photolithography on the front face of the glass substrate 4 (lower face in the figure) for lift off, and resist 105 spread on the pattern except for the fixed contact portion (see figure (e)). A vapor deposition layer 106 is then formed over the whole surface of the rear surface of the glass substrate 4 with gold or platinum (see figure (f)). Then the fixed contact points 11, 11 are formed by removing the vapor deposition layer 106 and the resist from the areas excluding the fixed contact portion 5 (see figure (g)).

Figure 13:
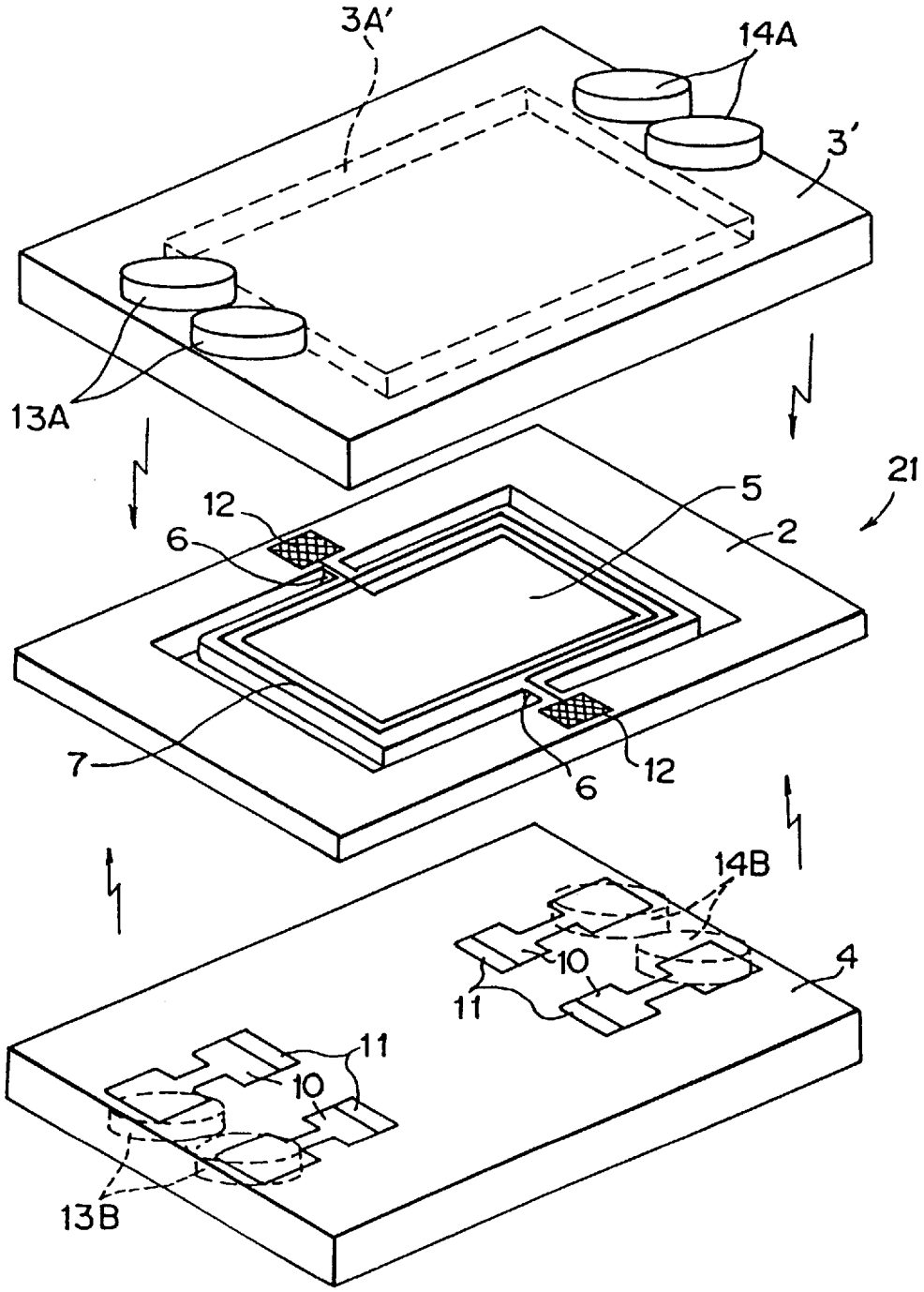
FIG. 13 is a perspective view showing the construction of a second embodiment of an electromagnetic relay according to the present invention.

FIG. 13 shows a second embodiment of an electromagnetic relay of the present invention. Elements the same as in the first embodiment are indicated with the same symbol and description is omitted.

In FIG. 13, with the electromagnetic relay 21 of this embodiment, the construction of the silicon substrate 2 and the lower glass substrate 4, is the same as for the first embodiment, while the construction of an upper glass substrate 3' differs. That is to say, with the upper glass substrate 3', the portion corresponding to the opening 3*a* of the upper glass substrate 3 of the first embodiment, is formed as a recess 3A' by for example discharge machining, to thus form a cover.

The upper glass substrate 3' and the lower glass substrate 4 are then joined to the upper and lower faces of the silicon substrate 2, as shown by the arrows in FIG. 13, by anodic splicing to thus seal off the swinging space of the movable plate 5. This sealed space is then evacuated, and the electromagnetic relay 21 operated. Now, instead of permanent magnets electromagnets may be used.

With this construction, by evacuating the swinging space for the movable plate 5, then there is no air resistance when the movable plate 5 moves, so that the movable plate response is improved. When the upper and lower glass substrates 3', 4 are joined to the silicon substrate 2, if a bonding agent is used there is the possibility of gas infiltrating into the swinging space for the movable plate. However if as with the present embodiment, anodic splicing is used, then this problem does not arise. Moreover, when vacuum sealing the swinging space for the movable plate 5, the dielectric strength can be improved by introducing sulfur hexafluoride $SF_6$ gas__.

A third embodiment of an electromagnetic relay according to the present invention will now be described with reference to FIG. 14. Elements the same as in the previous embodiments are indicated with the same symbol and description is omitted.

Figure 14:
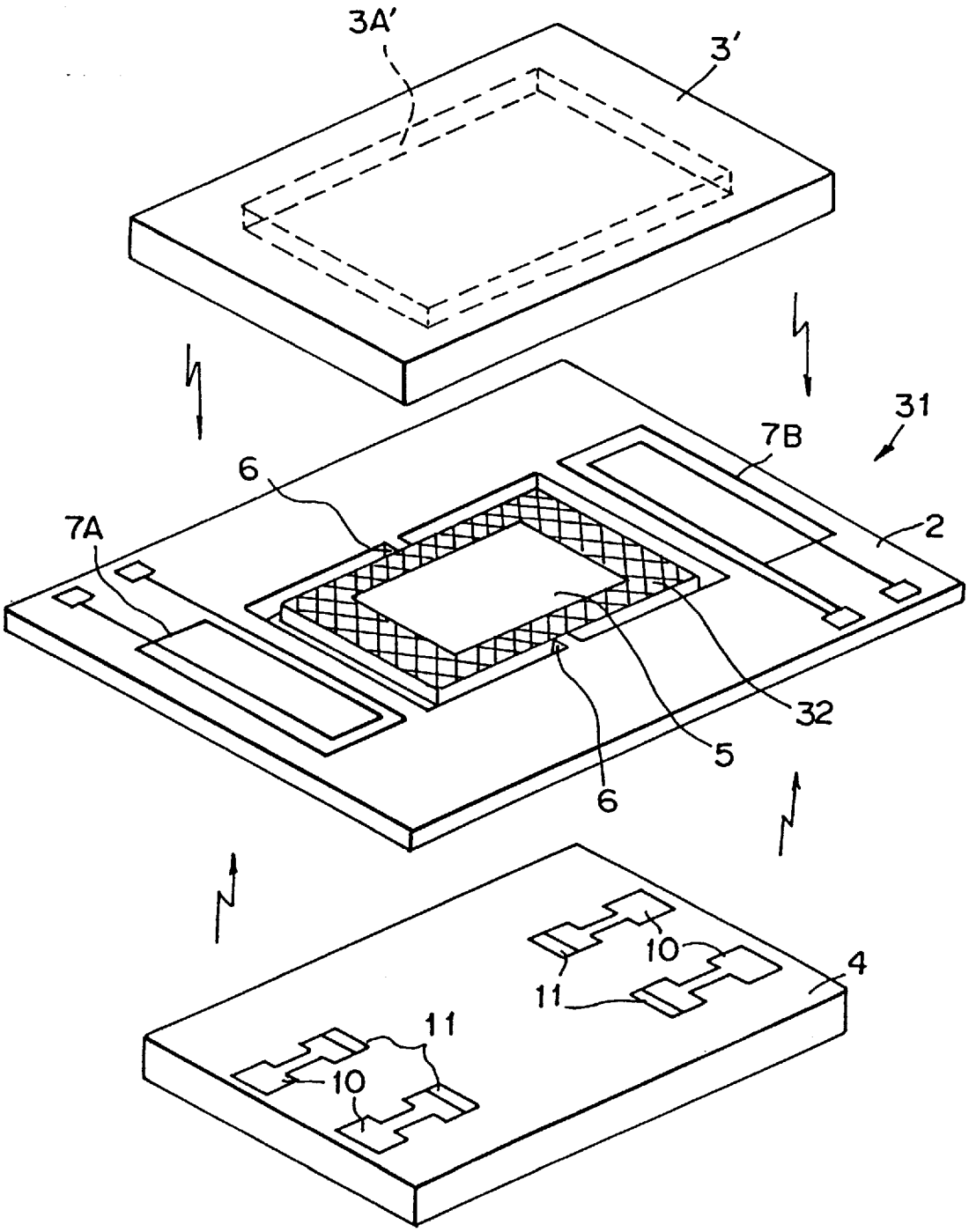
FIG. 14 is a perspective view showing the construction of a third embodiment of an electromagnetic relay according to the present invention.

With the electromagnetic relay of this embodiment as shown in FIG. 14, a thin film permanent magnet 32 is provided on the movable plate 5 instead of the planar coil. On the other hand, planar coils 7A, 7B for generating a magnetic field by means of an electric current, are provided on portions beside the opposite sides of the movable plate 5 which are parallel with the axis of the torsion bar 6, 6 of the silicon substrate 2. Moreover the upper glass substrate 3' has a recess 3A' the same as that of the substrate of FIG. 13, to thus form a cover.

With such a construction wherein the permanent magnet 32 is provided on the movable plate 5, and the planar coils 7A, 7B are provided on the silicon substrate 2, the same operation as for the beforementioned respective embodiments is possible. Furthermore, since a coil is not provided on the movable plate 5, then problems with heat generation do not arise. Moreover, since a thin film permanent magnet is used on the movable plate, then the situation of the movable plate becoming sluggish does not arise, and response is improved. In addition, since the thin film permanent magnet can be integrally formed by semiconductor element manufacturing techniques, then a further size reduction is possible as well as facilitating the permanent magnet positioning step, with advantages such as a simplification of the manufacture of the electromagnetic relay. Also, since the swinging space for the movable plate is sealed in a vacuum, then as with the embodiment shown in FIG. 13, good response of the movable plate 5 is obtained.

With the present embodiment, the construction is such that the permanent magnet is formed around the periphery of the movable plate. However the permanent magnet may be formed over the whole upper face of the movable plate.

With the present invention as described above, since the coil is formed using semiconductor element manufacturing techniques instead of the conventional wire wound type, then compared to the conventional electromagnetic relays using wire wound type coils, the device can be made much smaller and thinner. Accordingly integration and miniaturization of systems of control systems using electromagnetic relays becomes possible. Moreover, if the moving space of the movable plate is sealed and evacuated, then air resistance can be eliminated so that response performance of the movable plate is improved, enabling an increase in relay response performance.

INDUSTRIAL APPLICABILITY

The present invention enables a slim type and small size electromagnetic relay to be made, enabling the realization of miniaturization of control systems which control the output of a final stage using an electromagnetic relay. The invention thus has considerable industrial applicability.

We claim:

1. A planar type electromagnetic relay comprising:

a semiconductor substrate having:

planar plate rotatable about an axis in a plane of the semiconductor substrate;

a torsion bar for supporting the plate along the axis so that the plate is rotatable out of the plane of the semiconductor substrate;

a planar coil for generating a magnetic field by means of an electric current on an upper face peripheral edge portion of the plate; and a pair of movable contact portions provided on a lower face of the plate, said pair of movable contact portions being connected with an approximately C-shaped electric wiring, of which a side parallel to an axial direction of the torsion bar and facing a peripheral edge of the plate is open;

an insulating substrate attached to a lower face of the semiconductor substrate having a pair of fixed contact portions provided on an upper face of the insulating substrate at a location wherein the pair of fixed contact portions contacts said pair of movable contact portions when said plate is rotated; and magnets forming pairs with each other arranged so as to produce a magnetic field at portions of the planar coil on sides of the plate which are parallel with the axis of the torsion bar.

2. A planar type electromagnetic relay according to claim 1, wherein an upper substrate is provided on an upper face of the semiconductor substrate and said magnets are fixed to the upper substrate and to said insulating substrate.

3. A planar type electromagnetic relay according to claim 2, wherein the plate is disposed within an evacuated space formed by the upper substrate, the semiconductor substrate, and insulating substrate.

4. A planar type electromagnetic relay according to claim 3, wherein said space is formed by a recess in a central portion of said upper substrate, corresponding to a region above the plate.

5. A planar type electromagnetic relay according to claim 2, wherein said upper substrate is an insulating substrate.

6. A planar type electromagnetic relay according to claim 1, wherein said magnets are permanent magnets.

7. The planar type electromagnetic relay according to claim 1, wherein the semiconductor substrate, plate, and torsion bar are integrally formed.

8. The planar type electromagnetic relay according to claim 7, wherein the semiconductor substrate, plate, and torsion bar are integrally formed.

9. A planar type electromagnetic relay comprising:

a semiconductor substrate having:

a movable plate rotatable about an axis in a plane of the semiconductor substrate;

a torsion bar for supporting said plate along the axis so that the plate is rotatable out of the plane of said semiconductor substrate;

a permanent magnet provided on at least an upper face peripheral edge portion of said plate;

a pair of movable contact portions provided on a lower face of the plate, said pair of movable contact portions being connected with an approximately C-shaped electric wiring, of which a side parallel to an axial direction of the torsion bar and facing a peripheral edge of the plate is open;

a planar coil for generating a magnetic field by means of an electric current, provided on semiconductor portions beside sides of the plate which are parallel with the axis; and an insulating substrate attached to a lower face of the semiconductor substrate having a pair of fixed contact portions provided on the upper face of the insulating substrate at a location wherein the pair of fixed contact portions contacts the pair of movable contact portions when said plate is rotated.

10. A planar type electromagnetic relay according to claim 9, wherein an upper substrate is provided on an upper face of the semiconductor substrate, and the plate space formed by the upper substrate, the semiconductor substrate, and said insulating substrate.

11. A planar type electromagnetic relay according to claim 10, wherein said space is formed by a recess in a central portion of said upper substrate, corresponding to a region above the plate.

12. A planar type electromagnetic relay according to claim 10, wherein said upper substrate is an insulating substrate.

13. A planar type electromagnetic relay according to claim 9, wherein said permanent magnet is formed over the whole upper face of said movable plate.

14. A planar type electromagnetic relay according to claim 9, wherein said permanent magnet is of thin film construction.

* * * * *